US007036574B2

(12) United States Patent
Thompson et al.

(10) Patent No.: US 7,036,574 B2
(45) Date of Patent: May 2, 2006

(54) HEAT SINK

(76) Inventors: Andrew Lee Thompson, Riverside, Mill Lane, Bramford, Ipswich, Suffolk IP8 4AU (GB); Kim Leeson, 18 Elmhurst Road, Ipswich, Suffolk (GB)

( * ) Notice: Subject to any disclaimer, the term of this patent is extended or adjusted under 35 U.S.C. 154(b) by 0 days.

(21) Appl. No.: 10/807,862

(22) Filed: Mar. 24, 2004

(65) Prior Publication Data

US 2004/0226689 A1 Nov. 18, 2004

(30) Foreign Application Priority Data

Apr. 29, 2003 (GB) ..... 0309719

(51) Int. Cl.
*F28F 7/00* (2006.01)
*G06F 1/20* (2006.01)

(52) U.S. Cl. ..... 165/185; 165/80.3; 165/77

(58) Field of Classification Search ..... 165/80.3, 165/185, 76, 77, 78, 104.33; 361/697, 698, 361/700–704, 707, 709; 257/706, 707, 722; 174/16.3

See application file for complete search history.

(56) References Cited

U.S. PATENT DOCUMENTS

| | | | | |
|---|---|---|---|---|
| 4,316,236 | A * | 2/1982 | Lechner et al. | 361/831 |
| 5,161,087 | A | 11/1992 | Frankeny et al. | 361/382 |
| 5,822,187 | A * | 10/1998 | Garner et al. | 361/687 |
| 5,886,872 | A | 3/1999 | Koenen et al. | 361/719 |
| 5,923,179 | A | 7/1999 | Taylor | 324/755 |
| 6,086,387 | A * | 7/2000 | Gallagher et al. | 439/71 |
| 6,155,859 | A * | 12/2000 | Choy | 439/331 |
| 6,236,569 | B1 | 5/2001 | McEuen | 361/717 |
| 6,366,463 | B1 * | 4/2002 | Hamano | 361/704 |
| 6,447,322 | B1 * | 9/2002 | Yan et al. | 439/331 |
| 6,547,580 | B1 * | 4/2003 | Leavitt et al. | 439/266 |
| 6,741,089 | B1 * | 5/2004 | Conroy | 324/755 |
| 2003/0032322 | A1 * | 2/2003 | Nakamura et al. | 439/330 |

* cited by examiner

*Primary Examiner*—Tho Duong

(57) ABSTRACT

A heat sink arrangement for modular electronic and/or opto-electronic equipment is provided. The equipment module is inserted into an interface and a heat sink is pivotably arranged so as to be brought into contact with the inserted module. The equipment module may have an angled, or partially angled, so as to assist in bringing the module in contact with the heat sink.

10 Claims, 6 Drawing Sheets

HEAT SINK

BACKGROUND OF THE INVENTION

1. Field of the Invention

This invention relates to heat sinks for use with electronic devices and in particular for use with modular electronic devices that are received within a rack or a bay.

2. Brief Description of Related Developments

As the density of transistors in electronic devices and the power output levels and switching speeds of opto-electronic devices increase, there is a corresponding increase in the heat generated by such devices. As the electronic and/or opto-electronic devices are typically stored within enclosures the heat generated by their operation can lead to significant problems as some devices may be destroyed if their core temperature is too great, or the performance of the device may be substantially degraded. Known techniques used to control the temperature of individual devices include the use of heat sinks, heat pipes and fans, and fans are also used to draw cool air into the enclosure holding the electronic devices and to expel warm air from the enclosure.

It has been observed that these techniques, while generally being sufficient to control the generation of heat and to mitigate any effects caused by increased temperature, are less efficacious when used with modular electronic devices. An example of such a device is an opto-electronic transmission module that is received within an equipment rack. In order to facilitate maintenance and the fast replacement of failed modules, the modules, which are often referred to as pluggable modules, can be removed from or inserted into a bay within an equipment rack or mounting. As the module is slid into and out of the bay it is problematic to maintain an efficient thermal connection between the module and a heat sink, or other cooling equipment, that is provided inside the equipment rack so as to be in contact with an inserted module. If a module is replaced by a module that dissipates more heat then it may be necessary to access the interior of the equipment rack in order to change the cooling equipment.

SUMMARY OF THE INVENTION

According to a first aspect of the present invention there is provided a heat sink arrangement configured to receive an equipment module, the heat sink arrangement comprising alignment means to engage with the heat sink arrangement and a pivotable heat sink, the heat sink being pivoted by the insertion of the equipment module such that a surface of the heat sink is brought into contact with a surface of the equipment module.

The heat sink arrangement may further comprise an aperture for receiving the equipment module and the pivotable heat sink may be inclined such that the surface of the pivotable heat sink that makes contact with the equipment module is presented towards the aperture. One or more of the faces of the heat sink may comprise one or more protrusions and the support for the pivotable heat sink may comprise a heat pipe. The pivotable heat sink may further comprise gas- or liquid-cooling apparatus. The surface of the pivotable heat sink that makes contact with the equipment module may comprise a material that increases the diffusion of heat from the equipment module.

According to a second aspect of the present invention there is provided an equipment module for use with a heat sink arrangement according to any preceding claim, the equipment module having a substantially cuboidal form and comprising guide means for engaging with the alignment means of the heat sink arrangement. The surface of the equipment module that makes contact with the pivotable heat sink may comprise a material that increases the diffusion of heat from the equipment module and/or a material having a low coefficient of friction. The surface of the equipment module that makes contact with the pivotable heat sink may comprise an inclined region.

BRIEF DESCRIPTION OF THE DRAWINGS

The foregoing aspects and other features of the disclosed embodiments are explained in the following description, taken in connection with the accompanying drawings, wherein.

DETAILED DESCRIPTION OF THE PREFERRED EMBODIMENT(S)

Figure 1:
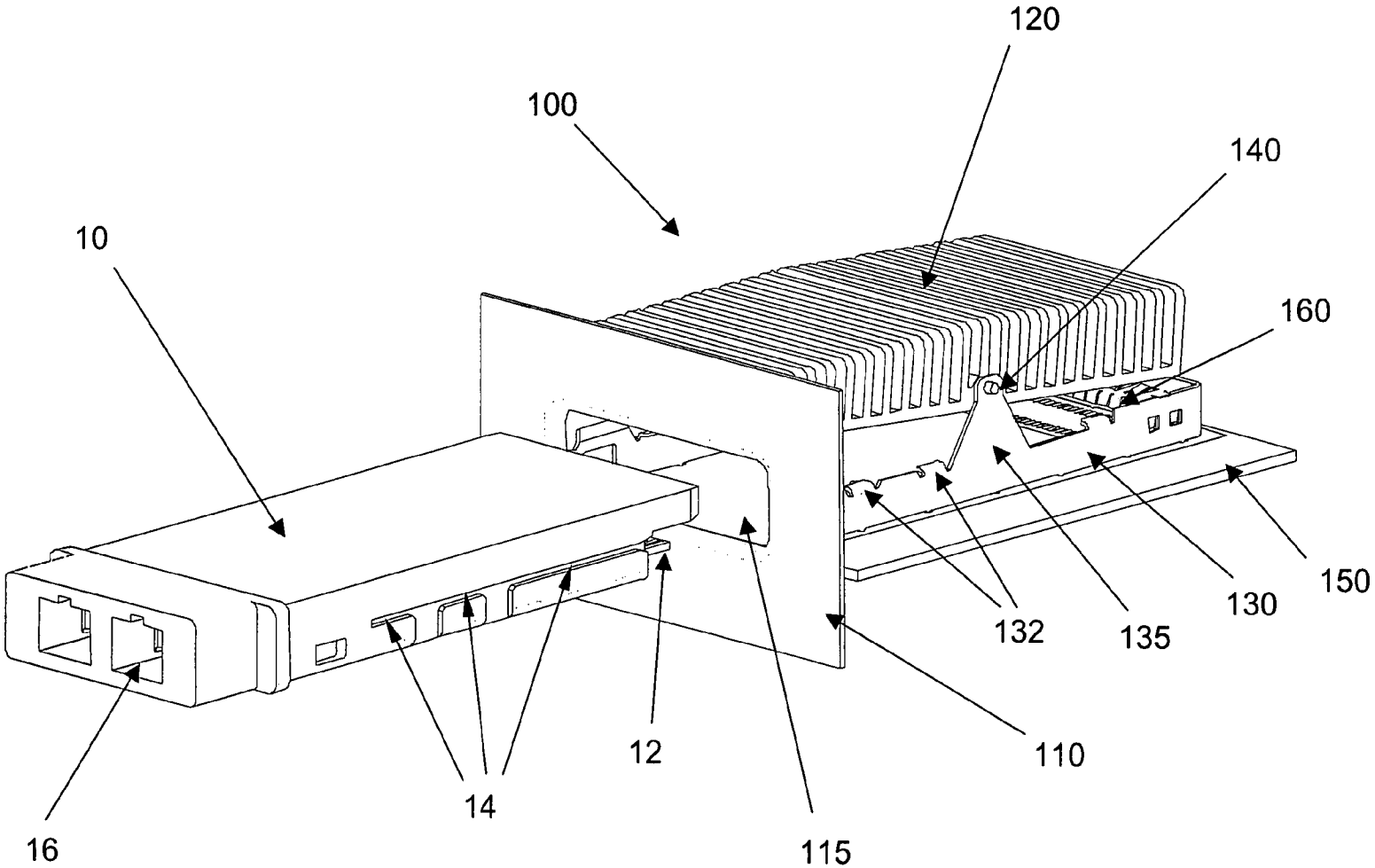
FIGS. 1 and 2 show schematic depictions of a heat sink arrangement according to the present invention and an equipment module that may be inserted into and removed from the heat sink arrangement.
Figure 2:
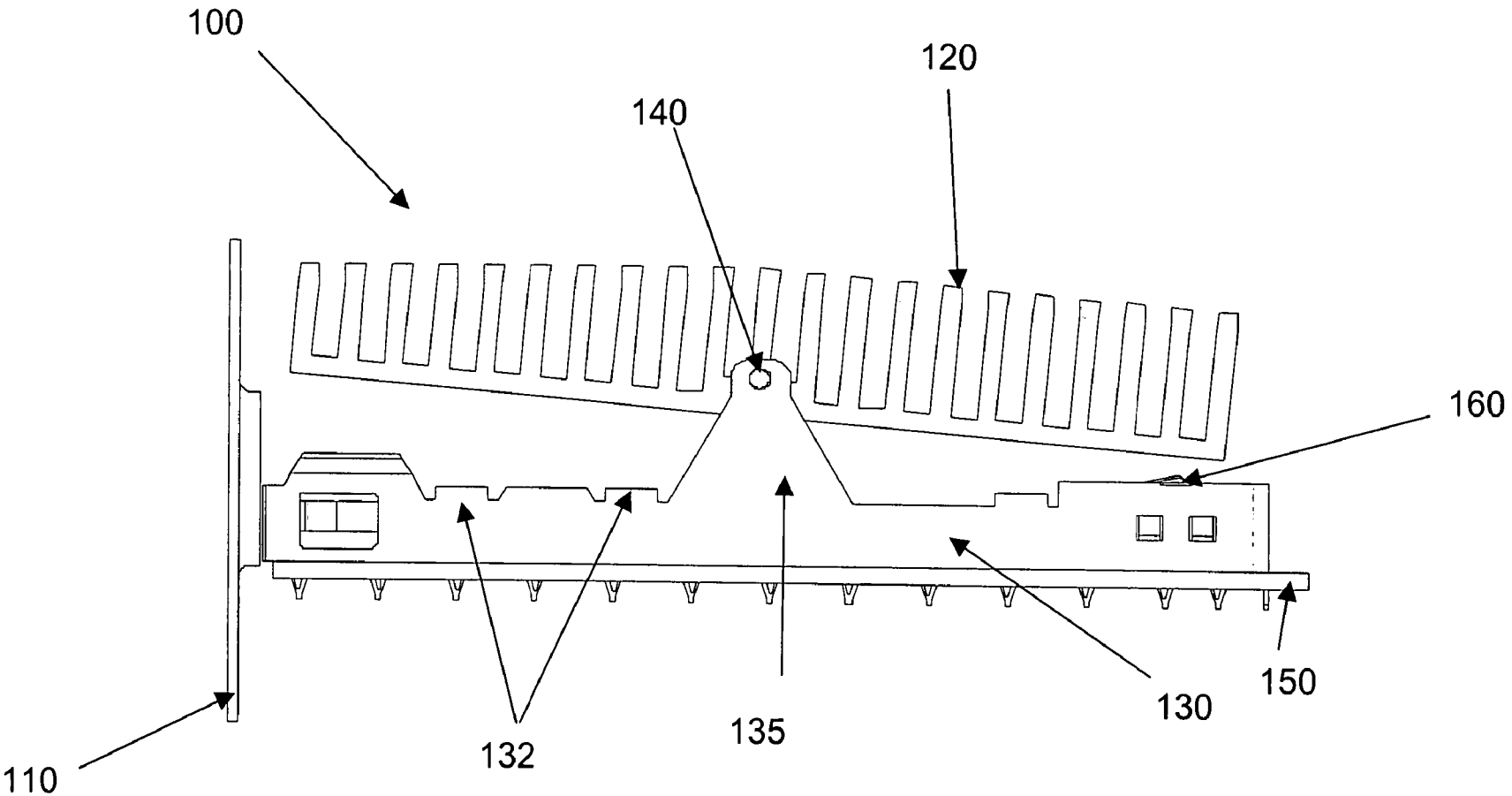

FIGS. 1 to 4 shows a schematic depiction of a heat sink arrangement 100 according to the present invention and an equipment module 10 that may be inserted into and removed from the heat sink arrangement 100. The equipment module 10 comprises internal communications interface 12, guide portions 14 and external communications interface 16. The internal communications interface is designed so as to be received within a corresponding interface within the heat sink arrangement 100 (see below) that is in communication with a transmission line or further piece of equipment. The external communications interface 16 is located on the front face of the equipment module that is not received within the heat sink arrangement for onward communication with a transmission line or a further piece of equipment. The guide portions 14 are preferably located on both side faces of the equipment module and are designed to engage with complementary features provided with the heat sink arrangement (see below) to assist the mechanical alignment of the equipment module within the heat sink arrangement and to secure the equipment module when fully inserted within the heat sink arrangement.

The heat sink arrangement 100 is received within an equipment rack (not shown) and comprises a front plate 110 comprising an aperture 115, a pivotable heat sink 120, support means 130, pivot pin 140, base 150 and equipment rack communications interface 160. The support means 130 comprises alignment means 132 and pivot arms 135, the pivot pin being received in and connected between the two pivot arms (referring to FIG. 1, the second pivot arm is hidden from view behind the heat sink 120). The support means 130 is mounted on the base 150 and the front plate is mounted on the base and the support means in a plane that is substantially orthogonal to the plane of the base. The pivotable heat sink is held by the pivot pin 140 and is free to pivot. The default position of the heat sink is to be pivoted slightly such that the flat side of the heat sink is pointed towards the aperture 115 within the front plate 110. This can be achieved by placing the pivot pin at an off-centre position on the heat sink, by designing the heat sink to have an asymmetric centre of gravity or by adding a small biasing spring to return the heat sink to the desired position when an equipment module is not present.

The equipment rack communications interface 160 is mounted within the support means and is positioned such that when an equipment module 10 is inserted into the heat sink arrangement 100 the internal communications interface is brought into communication with the equipment rack communications interface. The alignment means 132 of the support means are provided to engage with the guide portions of the equipment module such that when the equipment module is inserted into the heat sink arrangement the internal communications interface will be in alignment with the equipment rack communications interface. In FIG. 1 the guide portions comprise upstanding tab portions and the alignment means comprise tabs which are bent downwardly to engage with the guide portions but it will be understood that other geometries and forms of guide portions and alignment means may be used. An advantage of the arrangement shown in FIGS. 1–4 is that the alignment means provide EMI shielding for the equipment module.

Figure 3:
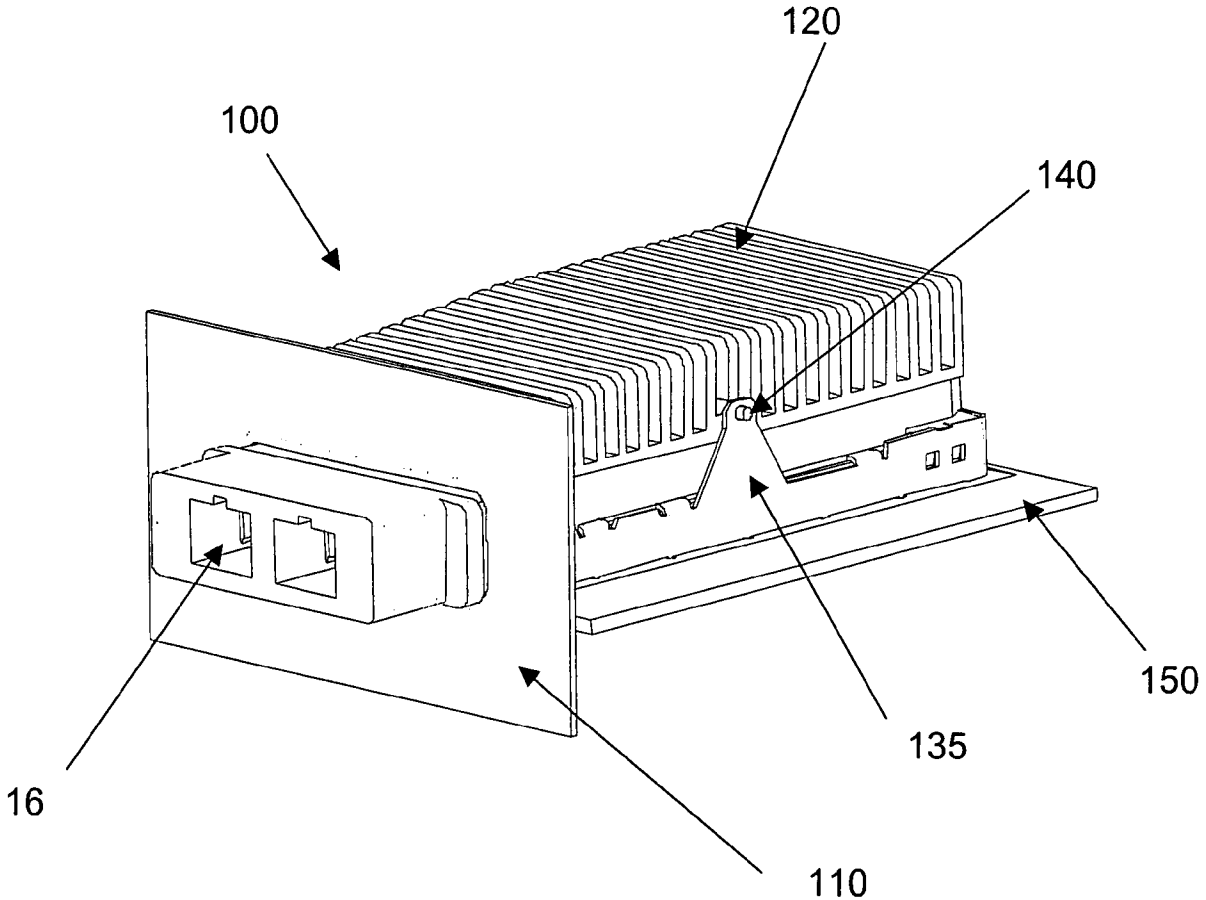
FIGS. 3 and 4 show schematic depictions of a an equipment module inserted into a heat sink arrangement according to the present invention.
Figure 4:
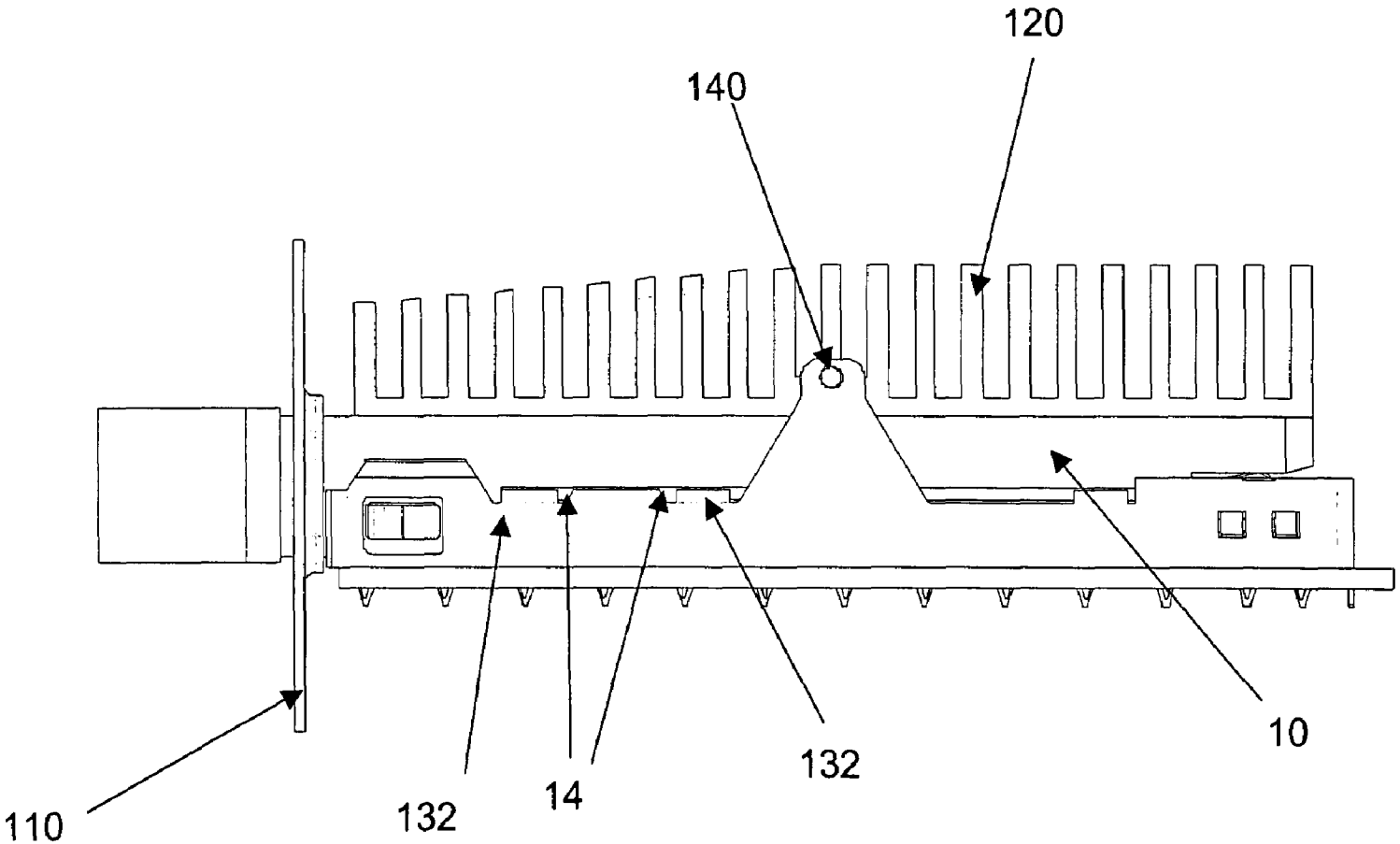

When an equipment module is inserted into the heat sink arrangement, the upper face of the module will cause the heat sink 120 to pivot, bringing the lower surface of the heat sink into contact with the upper surface of the equipment module (see FIGS. 3 and 4). The pivoting arrangement increases the contact area between the equipment module and the heat sink, increasing the transfer of heat between the equipment module and the heat sink.

FIGS. 3 and 4 show schematic depictions of an equipment module 10 inserted into a heat sink arrangement 100 according to the present invention, with FIG. 3 showing a perspective view and FIG. 4 showing a side view. In a preferred embodiment of the invention, the pivot pin 140 may comprise a heat pipe that can carry heat away from the heat sink 120.

Figure 5:
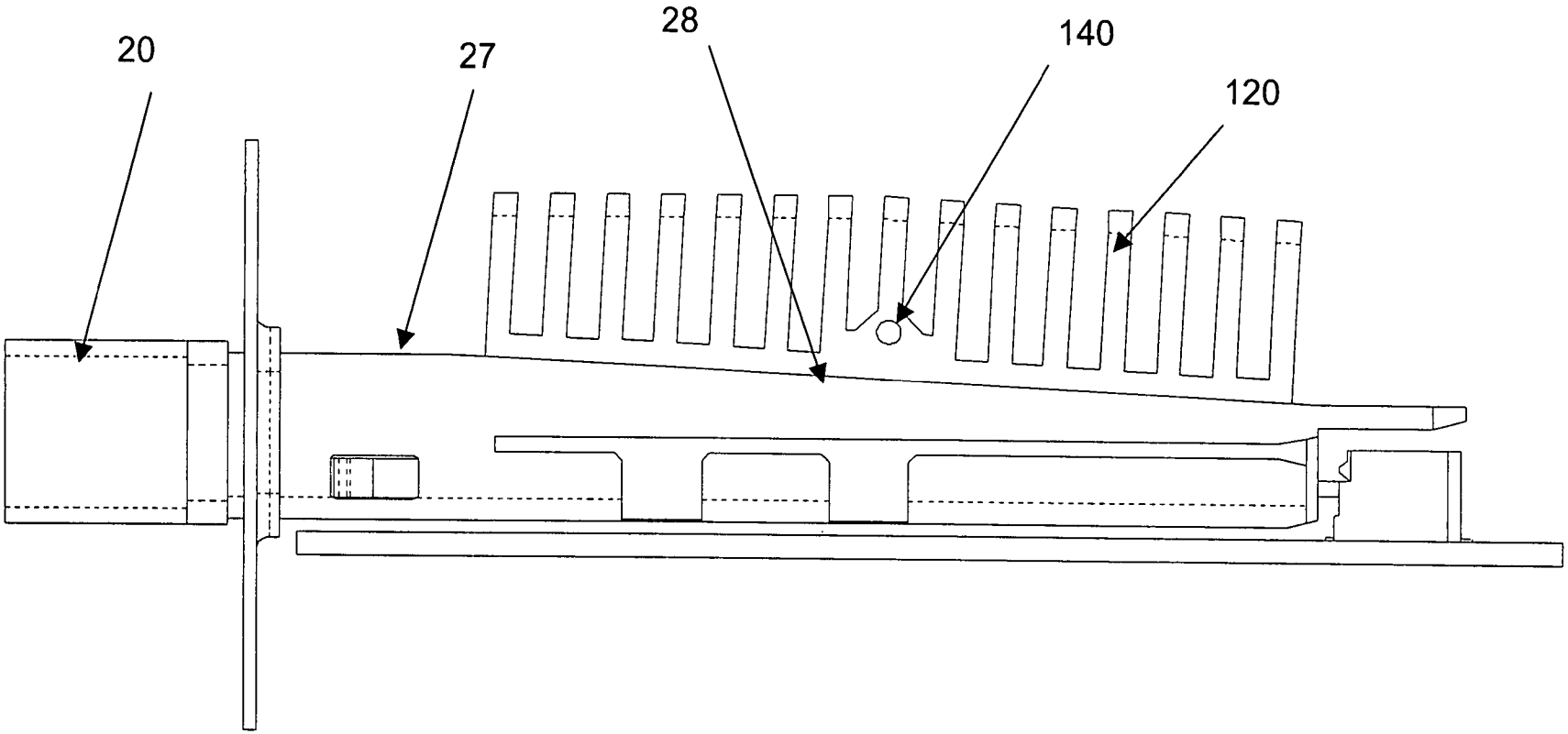
FIG. 5 shows a schematic depiction of a side view of one embodiment of the present invention.

FIG. 5 shows a schematic depiction of the side view of an alternative embodiment of the present invention in which the equipment module 20 differs from the equipment module 10 described above with reference to FIGS. 1 to 4 in that the equipment module 20 has a non-uniform cross-section. The contact face (i.e. the face that is brought into contact with the heat sink) is divided into a first flat region 27 and a second angled region 28, the angled region being closest to the face of the equipment module 20 that is inserted into the heat sink arrangement. It has been found that the angled region 28 assists in bringing the equipment module 20 into contact with the heat sink.

The contact area between the equipment module and the heat sink should be sufficient to couple the heat dissipated by the equipment module but it is possible to improve the thermal contact by attaching an interface material to the surface of the heat sink that come into contact with the equipment module, such as a thermal matting or a suitable phase change material. Although the heat sink 120 shown in FIGS. 1–4 comprises a plurality of fins in order to increase heat dissipation, it will be understood that the heat sink could alternatively be a flat heat spreader, or that fins could be attached to a limited region of the heat sink. Furthermore, additional techniques and technology may be used to provide an increased degree of heat dissipation; fans may be mounted to the heat sink; the pivot pin 140 may comprise a heat pipe, the heat sink may be cooled using a gas- or liquid-cooling system, the heat sink may comprise one or more regions that act as planar heat pipes, etc.

The material used to form the upper surface of the equipment module preferably has one or more of the following characteristics:

- a low coefficient of friction to ease insertion and extraction of the module;
- a high thermal conductivity to increase the dissipation of heat away from the module and towards the heat sink;
- sufficient mechanical strength to withstand repeated insertion and extraction of the module; and
- a degree of mechanical compression that will reduce the mechanical tolerances required for the components required.

A suitable material is Sarcon® GHR-AD from Fujipoly Europe Ltd., which comprises a glass-reinforced silicone rubber having a high thermal conductivity. The material may be provided with an adhesive coating for connection to the equipment module or other surfaces. Sarcon® GHR-AD also has a relatively low coefficient of friction although it is possible that a material having a lower coefficient of friction, such as PTFE, may be added to the Sarcon®.

Figure 6:
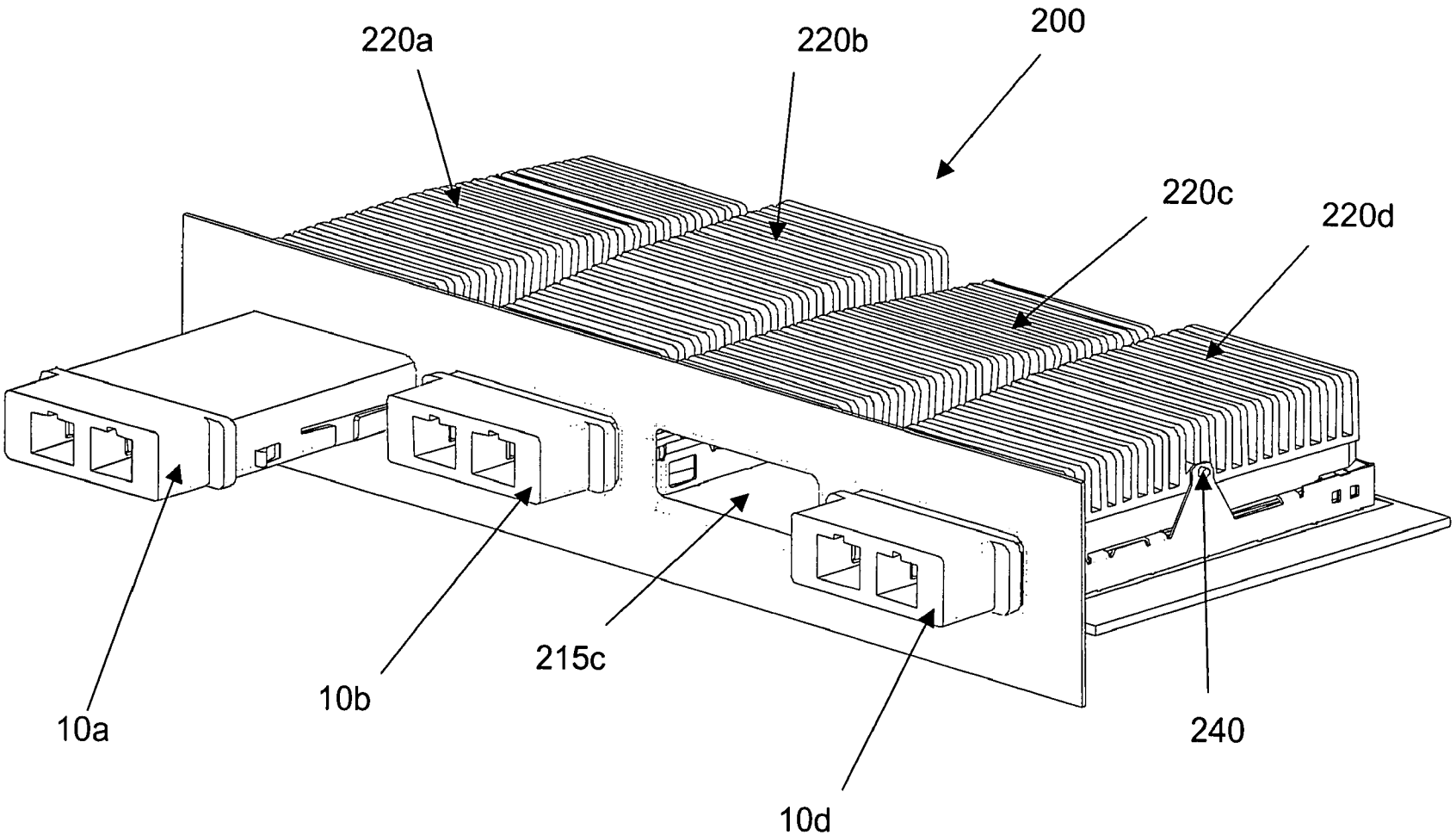
FIG. 6 shows a schematic depiction of another embodiment of the present invention.

FIG. 6 shows a schematic depiction of a further embodiment of the present invention. Heat sink arrangement 200 comprises heat sinks 220*a*, 220*b*, 220*c*, 220*d*, which are all connected by pivot pin 240. Each heat sink has an associated aperture 215*a*, 215*b*, 215*c* and 215*d* and in FIG. 6 apertures 215*a*, 215*b* and 215*d* contain equipment modules 10*a*, 10*b* and 10*d* respectively, whilst aperture 215*c* is vacant. As the heat sinks are connected by the pivot pin, the pin will assist in the distribution of heat between adjacent heat sinks, also making use of heat sinks that are not in contact with an equipment module (such as heat sink 215*c* as shown n FIG. 6). It will be readily understood that the invention may be adapted to incorporate any number of equipment modules, as equipment racks used in telecommunications and data communications applications may comprise 48 modules or more.

It will be understood that the equipment module may comprise electronic equipment, electro-optical equipment or all optical equipment. Although the invention has been described above with specific reference to modular units such as may be used in data communications, it will be understood that the present invention may be applied to other applications where cooling may be required, for example for cooling CPUs, hard drives or other devices in computers.

What is claimed is:

1. A heat sink arrangement configured to receive an equipment module, the heat sink arrangement comprising a support means with alignment means for engaging the equipment module and a pivotable heat sink, the heat sink being pivoted by the action of inserting the equipment module into the support means such that a surface of the heat sink is brought into contact with a surface of the equipment module.

2. A heat sink arrangement according to claim 1, wherein the heat sink arrangement further comprises an aperture for receiving the equipment module and the pivotable heat sink is inclined such that the surface of the pivotable heat sink that makes contact with the equipment module is presented towards the aperture.

3. A heat sink arrangement according to claim 1, further comprising one or more faces having one or more protrusions.

4. A heat sink arrangement according to claim 1, further comprising a support for the pivotable heat sink including a heat pipe.

5. A heat sink arrangement according to claim 1, wherein the pivotable heat sink further comprises gas-or liquid-cooling apparatus.

6. A heat sink arrangement according to claim 1, wherein the surface of the pivotable heat sink that makes contact with the equipment module comprises a material that increases the diffusion of heat from the equipment module.

7. A heat sink arrangement according to claim 1, wherein the equipment module has a substantially cuboidal form and includes guide means for engaging with the alignment means of the support means.

8. A heat sink arrangement according to claim 7, wherein the surface of the equipment module that makes contact with the pivotable heat sink comprises a material that increases the diffusion of heat from the equipment module.

9. A heat sink arrangement according to claim 7, wherein the surface of the equipment module that makes contact with the pivotable heat sink comprises a material having a low coefficient of friction.

10. A heat sink arrangement according to claim 7, wherein the surface of the equipment module that makes contact with the pivotable heat sink comprises an inclined region.

* * * * *